United States Patent [19]

Nakagawa

[11] 4,329,765

[45] May 18, 1982

[54] METHOD FOR MANUFACTURING A SPRING RING TO BE ELECTROPLATED

[75] Inventor: Shigesaburo Nakagawa, Ichikawa, Japan

[73] Assignee: Nakawa Corporation, Tokyo, Japan

[21] Appl. No.: 79,993

[22] Filed: Sep. 28, 1979

[51] Int. Cl.[3] ..... B23P 15/00

[52] U.S. Cl. ..... 29/160.6; 29/436; 29/458

[58] Field of Search ..... 29/160.6, 436, 458; 204/30, 38 E; 24/239, 240, 238

[56] References Cited

U.S. PATENT DOCUMENTS 1,017,458 2/1912 Piper ..... 24/239 X
1,057,532 4/1913 Elliott ..... 24/239 X
3,350,764 11/1967 Geldwerth ..... 29/160.6

*Primary Examiner*—Frank T. Yost
*Attorney, Agent, or Firm*—Armstrong, Nikaido, Marmelstein & Kubovcik

[57] ABSTRACT

A method for manufacturing a spring ring to be electroplated in subsequent processes wherein, on the occasion of assembling a movable core member to open and close a opening of a link body and a spring to push the said movable core member in a direction to close the said opening in a circular and tubular link body opened at one end and brazed with a ring on another, the spring is previously coated with a electrically non-conducting film by means of a coating treatment and then assembled into the said tubular link body.

8 Claims, 1 Drawing Figure

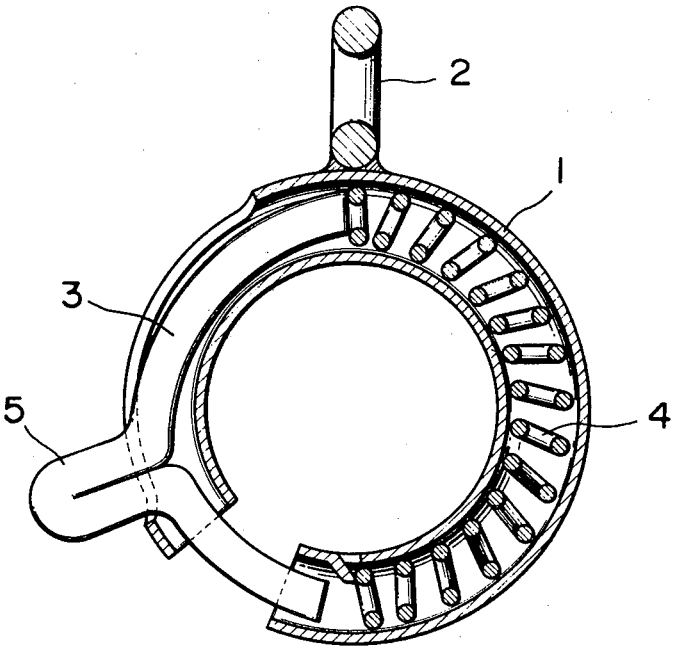
2
1
3
5
4

METHOD FOR MANUFACTURING A SPRING RING TO BE ELECTROPLATED

The present invention relates to a method for manufacturing a spring ring to be electroplated in subsequent processes so that a movable core member provided therein can move smoothly after the spring ring is electroplated.

Spring rings made of brass, for example, have hitherto been widely used as a connecting component of moderate price and good function for personal ornaments such as a necklace or the like. The spring rings made of brass are usually subjected to a electroplating process together with other component parts such as chains after the spring rings have been worked into necklaces or the like except in such specific cases as when they are used for such items as necklaces made of glass, plastic, or crystal beads strung in a row with a thread. In other words, the brass spring rings, the main object of this invention, are sometimes sold already electroplated but usually supplied to the manufacturers of necklaces or the like as component parts without electroplating.

The conventional method for manufacturing a spring ring is brazing a ring to a circular, tubular link body with a opening at one end 1, assembling a movable core member 3 to open and close the opening of the said link body 1 into the ring and providing in the ring a spring 4 to push the movable core member 3 in a direction to close the opening as shown in FIG. 1. The completed spring rings are then electroplated individually or after they have been further worked into necklaces or the like.

Also, the spring ring is so arranged that the opening of the tubular link body 1 is opened by moving the movable core member 3 against the spring 4 with a finger acting on a operating projection 5 of the movable core member 3 and is closed by returning the movable core member 3 with restoration of the spring 4 after release of the finger.

However, in the conventional method for manufacturing the spring ring, the movable core member 3 has occasionally not been smoothly movable after being electroplated, particularly when the core member has been plated to a thickness exceeding 10 micron as in the case of bright nickel plating, thus raising a problem of producing defective products.

The inventor of this invention had pursued the cause of the defective spring rings by encasing them into resin and cutting specimens which were ground and etched to be examined with a microscope. As a result of such microscopic observation, it was elucidated that some parts within the tubular link body 1, especially where the inside wall of the tubular link body 1 contacts the spring 4, were invaded with the plating solution to cause some metal deposit joining the spring 4 to the inside wall of the tubular link body 1, thereby obstructing the movable core member 3 from operating smoothly.

Also, a quality examination was carried out on the spring rings in each step of the manufacturing processes, especially after the pre-plating and post-plating processes. As a result of this examination, it was also elucidated that during the pre-plating processes consisting of vapour and electrolytic degreasing, acid treatment and water rinsing, an oil kept inside of the spring ring body until then had been completely removed, thereby obstructing a smooth operation of the movable core member 3 and the spring 4.

Furthermore, in the conventional method, when the spring 4 was oiled through the slit of the link body 1 and then the movable core member 3 moved several times after electroplating, the movable core member 3 could be improved to some extent to move more smoothly. However, such effort of repairing every product for a large quantity after electroplating required tremendous labor thus raising the manufacturing cost.

From this knowledge and expertise and by repeated experiments and researches, the inventor of this invention had confirmed the required effects of this invention to propose a spring ring of which the said core member can smoothly move even after being electroplated, by first coating the spring with a electrically non-conducting film by a coating treatment prior to assembly and thereafter assenbling the movable core member and the spring into the afore-said tubular link body to complete the spring ring.

Although there might be possible a method of coating only the inside wall of the tubular link body with a electrically non-conducting film, it is extremely difficult to coat the electrically non-conducting film only on its inside wall due to the construction of the tubular link body. Moreover, such a electrically non-conducting film on the inside wall may obstruct electric conductivity of the core member in the subsequent plating processes because the core member should be plated too. Further, a coating in the link body may not be able to withstand the high temperature of brazing a ring 2 to the link body 1 even if the body could be coated before making the tubular link body.

BRIEF DESCRIPTION OF DRAWING

FIG. 1 shows a sectional view of a spring ring of the present invention.

DETAILED DESCRIPTION OF THE INVENTION

The details and advantages of the invention will be apparent from the following description of a embodiment with the accompanying drawing.

A circular and tubular link body 1 with a opening at one end is brazed with a ring 2 as shown in FIG. 1. Meanwhile, a spring 4 is immersed in a appropriate synthetic resin lacquer solution and subjected to a centrifugal drying so that the spring 4 is thinly and evenly coated with a electrically non-conducting film.

It is preferable that the electrically non-conducting film be insoluble to solutions and solvents such as trichlorethylene used in the vapour degreasing or alkaline solutions used in the electrolytic degreasing process during the degreasing steps and hydrochloric acid or sulfuric acid used for acid pickling or activation, or the like of the pre-plating treatment, and plating baths; and also somewhat lubricative to the inner wall of the tubular link body 1. Since many synthetic resin or plastic lacquer films or wax films have such a property, an appropriate one can be selected from them.

Then, the spring 4 coated with the electrically non-conducting film by means of the coating treatment and the movable core member 3 are assembled into the tubular link body 1 to complete a spring ring by the conventional way. Thus assembled spring rings or after further assembled spring rings into a necklace or the like normally are subjected to a bright nickel plating at first after the pre-plating processes such as degreasing, acid activating and the like, then to a ornamental plating such as gold, silver, rhodium or the like.

The method of the present invention to manufacture a spring ring which should be electroplated afterwards prevents a metal deposit on the spring while electroplating by coating the said spring with the electrically non-conducting film by a way of coating treatment thus preventing the said spring from clinging to the inside wall of the tubular link body due to the metal deposit where they contact each other. This further allows the movable core member of the spring ring to smoothly operate even after electroplating due to the lubricative property of the afore-said electrically non-conducting film, without any essential and costly changes of the manufacturing process of the spring ring but only with a simple process added to attain the expected advantages proposing a considerable industrial benefit.

What is claimed is:

1. In a method of manufacturing a spring ring which comprises:

a tubular link body;

a ring brazed on the body;

a movable core member in the tubular link body to open and close an opening in the body; and a spring contained in the body biasing the core member towards closing the opening;

the step of coating the spring with an electrically non-conducting film prior to assembly into the link body and prior to electroplating.

2. A method of manufacturing a spring ring which comprises:

brazing a ring onto a tubular link body;

coating a spring with an electrically non-conducting film;

assembling the coated spring together with a movable core member into the tubular link body;

and electroplating the assembly.

3. A method for manufacturing a spring ring as defined in claim 2, further comprising:

working the assembly into a larger piece of jewelry prior to electroplating.

4. A method for manufacturing a spring ring as defined in claim 2 wherein the electroplating comprises pre-plating treating including degreasing and acid pickling, undercoating plating, and final ornamental plating of a material selected from the group consisting of gold, silver, and rhodium.

5. A method for manufacturing a spring ring as defined in either claim 1 or 2, wherein the electrically non-conducting film is selected from the group consisting of a resin and a wax.

6. A method for manufacturing a spring ring as defined in either claim 1 or 2, wherein the electrically non-conducting film is chemically inert to solution utilized in the electroplating.

7. A method for manufacturing a spring ring as defined in either claim 1 or 2, wherein the electrically non-conducting film lubricates the tubular link body of the spring ring.

8. A method for manufacturing a spring ring as defined in either claim 1 or 2, wherein the spring ring is made of brass.

* * * * *

UNITED STATES PATENT AND TRADEMARK OFFICE

CERTIFICATE OF CORRECTION

PATENT NO. : 4,329,765

Dated : May 18, 1982

INVENTOR(S) : SHIGESABURO NAKAGAWA

It is certified that error appears in the above-identified patent and that said Letters Patent are hereby corrected as shown below:

On the title page item [73]

Name of Assignee "Nakawa" should be corrected to read, "Nakagawa."

Signed and Sealed this

*Fourteenth* Day of *December 1982*

[SEAL]

*Attest:*

GERALD J. MOSSINGHOFF

*Attesting Officer*

*Commissioner of Patents and Trademarks*